United States Patent [19]

Greczin

[11] 3,977,214

[45] Aug. 31, 1976

[54] ANGULARLY OFFSET NEEDLE KNITTING MACHINE

[76] Inventor: John Greczin, 7312 School Lane, Philadelphia, Pa. 19126

[22] Filed: Apr. 29, 1975

[21] Appl. No.: 572,737

[52] U.S. Cl. ..... 66/9 A; 66/115

[51] Int. Cl.[2] ..... D04B 15/10

[58] Field of Search ..... 66/9 A, 8, 115, 50 B

[56] References Cited

UNITED STATES PATENTS

| | | | |
|---|---|---|---|
| 281,804 | 8/1883 | Simonson | 66/8 |
| 1,035,656 | 8/1912 | Swinglehurst | 66/115 |
| 1,244,267 | 10/1917 | Wilcomb | 66/115 |
| 1,797,006 | 3/1931 | Lombardi | 66/50 B |
| 2,222,287 | 11/1940 | Ford | 66/9 A |
| 2,252,596 | 8/1941 | Grant | 66/9 A |
| 2,259,384 | 10/1941 | Larkin | 66/9 A |
| 2,568,806 | 9/1951 | Henning | 66/9 A |
| 2,951,355 | 9/1960 | Bryant | 66/8 |
| 3,543,280 | 11/1970 | Greczin | 66/9 A |

FOREIGN PATENTS OR APPLICATIONS

| | | | |
|---|---|---|---|
| 893,613 | 8/1944 | France | 66/8 |
| 821,735 | 12/1937 | France | 66/8 |
| 1,008,438 | 5/1957 | Germany | 66/8 |
| 712,201 | 8/1966 | Italy | 66/8 |

*Primary Examiner*—Mervin Stein
*Assistant Examiner*—Andrew M. Falik
*Attorney, Agent, or Firm*—Weiser, Stapler & Spivak

[57] ABSTRACT

In a circular knitting machine of the type designed to knit a tubular fabric, a plurality of circumferentially spaced knitting needles are reciprocal in an inclined mode between a latch clearing position and a stitch forming position. The needle cylinder is provided with circumferentially inclined slots or grooves within which the knitting needles reciprocate in angularly offset relation from the vertical. Cam rings forming the cam track are rotated in a horizontal plane upon operation of the knitting machine to reciprocate the knitting needles in their angularly offset orientation.

14 Claims, 7 Drawing Figures

12
40
42
14
28
30
44
20
52
63
18
58
56
10
50
20
46
16
16
26
64
36
60
60
32
34
38
22
27
31
60

FIG. 2
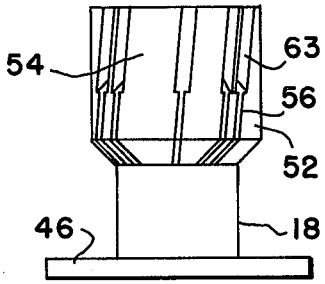
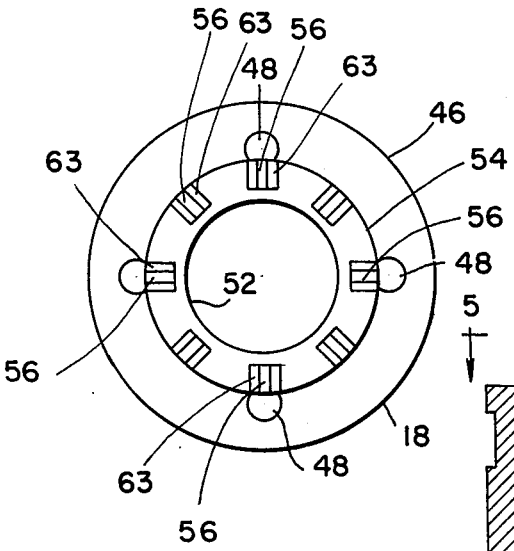
FIG. 3
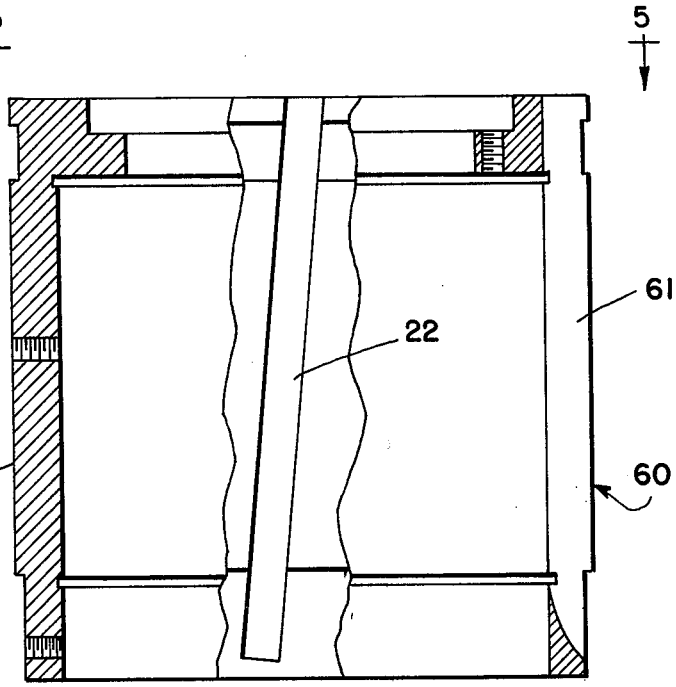
FIG. 4
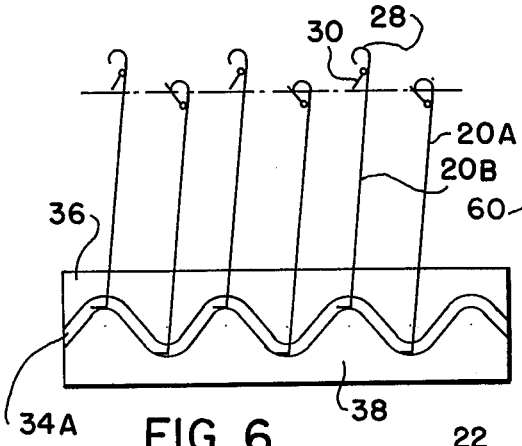
FIG. 6
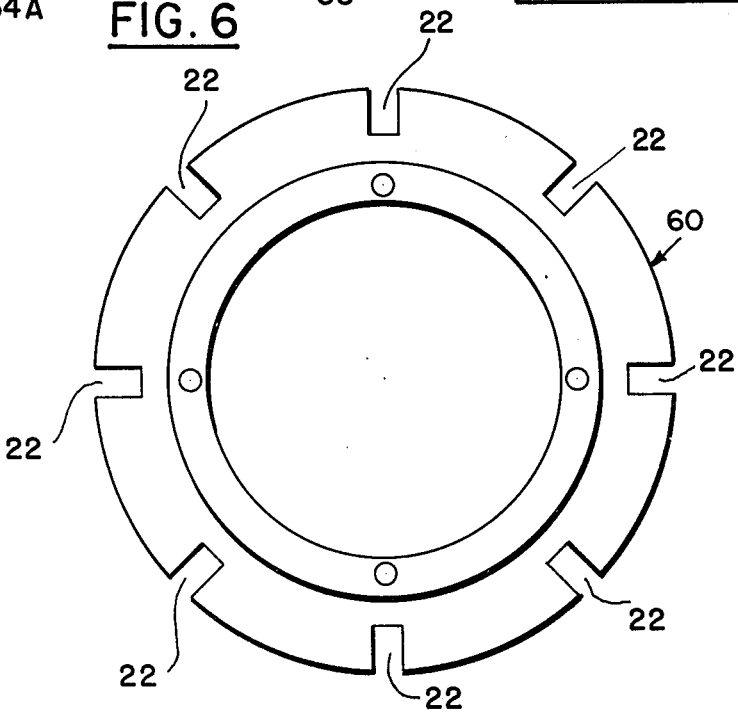
FIG. 5

ANGULARLY OFFSET NEEDLE KNITTING MACHINE

BACKGROUND OF THE INVENTION

The present invention relates generally to the art of knitting, and more particularly, is directed to a circular type knitting machine which may be employed to knit a tubular fabric.

In the production of tubular knit fabrics, it has been the usual practice to employ circular knitting machines including a needle cylinder which is provided with a plurality of circumferentially spaced slots. Latch needles vertically reciprocate within the slots between stitch forming and latch clearing positions to produce a knitted fabric in accordance with a predetermined pattern. The circular cam is rotated relative to the needle cylinder and includes a cam track within which are positioned the butts of the knitting needles. Accordingly, as the cam is rotated upon operation of the machine, the interaction of the cam track and the knitting needle butts vertically reciprocates the knitting needles within the various needle cylinder slots in a known manner to produce a knitted tubular fabric.

The cam track of the prior art circular knitting machines circumferentially extends about the needle cylinder and generally follows an undulating path to thereby reciprocate the latch needles between their stitch forming and latch clearing positions. The cam track first raises the needle by engagement of the lower portion of the butt in the cam track and then lowers the needle to draw the stitch by engagement of the upper portion of the butt in the cam track. It has been found that if the angle between the needle and the normal to the cam track exceeds forty-five degrees, binding of the needle butts, excessive wear, and in many instances needle breakage occurs. This angle is usually referred to as the pressure angle. Due to the vertical orientation of the knitting needles and the angular orientation of the cam track, the prior art circular knitting machines have been designed for operation near the pressure angle. This design causes considerable friction at the cam track. The friction eventually results in wear sufficient to cause looseness or slap action of the needle latches and a decrease in machine component life due to wear.

SUMMARY OF THE INVENTION

The present invention relates generally to the field of circular knitting machines and more particularly, is directed to a circular knitting machine having a circumferential angularly offset knitting needles.

The knitting machine of the present invention incorporates a novel knitting needle orientation which is circumferentially angularly offset from the vertical. The slots in the needle cylinder are angularly offset from the vertical approximately five degrees and the needles are vertically reciprocated within the angularly offset needle cylinder slots. The cam rings conventionally rotate in a horizontal plane and the cam track is preferably constructed similarly to the cam tracks of conventional circular knitting machines. The butts of the angularly offset knitting needles ride within the cam tracks in the usual manner and due to the angular inclination of the needles, pressure angle is reduced and the butts ride more easily within the cam track and with less friction. The angular orientation of the needles relative to the vertical axis of the machine reduces slap action of the latches due to wear to thereby result in longer needle life. The angular orientation of the needle butts riding within the cam track reduces binding, friction and resultant wear. Additionally, the entire device can be operated at reduced power requirements due to the decreased frictional resistance.

It is therefore an object of the present invention to provide an improved circular knitting machine of the type set forth.

It is another object of the present invention to provide a novel circular knitting machine which includes angularly offset means to guide the knitting needles in circumferentially angularly offset orientation.

It is another object of the present invention to provide a novel circular knitting machine which includes means to reciprocate the knitting needles in an angularly inclined relationship and means to guide the knitting needles in angularly offset paths.

It is another object of the present invention to provide an improved circular knitting machine including cam rings which rotate in a horizontal orientation and knitting needles reciprocated by the cam track which are positioned in an angularly inclined relationship to the cam track of less than 45°.

It is another object of the present invention to provide a novel circular knitting machine including a needle cylinder and a needle stem in vertical relationship wherein the needle cylinder and the needle stem are each provided with needle grooves which are circumferentially angularly offset from the vertical.

It is a further object of the present invention to provide a novel circular knitting machine that is inexpensive in manufacture, simple in design and trouble free when in use.

Other objects and a fuller understanding of the invention will be had by referring to the following description and claims of a preferred embodiment thereof, taken in conjunction with the accompanying drawings wherein like reference characters refer to similar parts throughout the several views and in which:

BRIEF DESCRIPTION OF THE DRAWINGS

FIG. 2 is a side elevational view of the needle stem forming a portion of the machine of FIG. 1.

FIG. 3 is a top plan view of the needle stem of FIG. 2, looking from Line 3—3.

FIG. 4 is an elevational view of the needle cylinder of the machine of FIG. 1, partially broken away and partially in section to illustrate construction details.

FIG. 5 is a top plan view of the needle cylinder of FIG. 4, looking from Line 5—5.

FIG. 6 is a schematic elevational view showing the reciprocation of the knitting needles.

DESCRIPTION OF THE PREFERRED EMBODIMENT OF THE INVENTION

Figure 1:
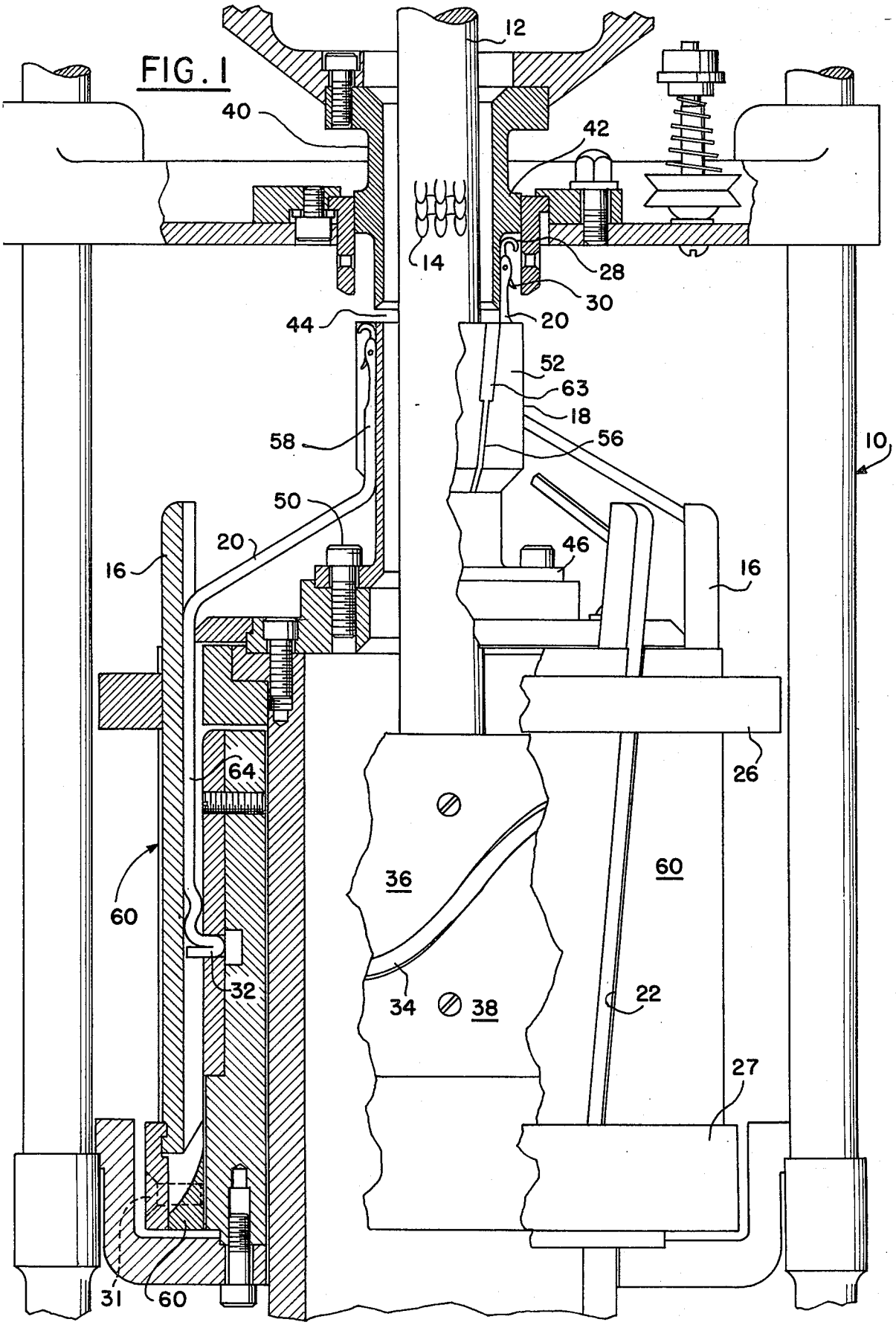
FIG. 1 is a partial, elevational view of a circular knitting machine employing the present invention, partially broken away and partially in section to expose details of interior construction.

Although specific terms are used in the following description for the sake of clarity, these terms are intended to refer only to the particular structure of my invention selected for illustration in the drawings and are not intended to define or limit the scope of the invention.

The invention has herein been illustrated and described in conjunction with the type of circular knitting machine which is well known in the art and which has been developed to produce a tubular knit fabric which serves as a reinforcement for flexible hose and which is knitted in place upon the exterior surface of the hose as it is drawn through the machine. Such a machine has been illustrated and described in U.S. Pat. No. 3,543,280 and so need not be described in detail. Inasmuch as the invention resides in the particular construction of the needle stem and needle cylinder and in the orientation of the knitting needles themselves, only so much of the knitting machine proper is shown and described as is necessary to identify, locate and describe the function of these parts.

Referring now to the drawings, I show in FIG. 1 a portion of a circular knitting machine similar to that illustrated in U.S. Pat. No. 3,543,280 and which is generally designated 10. A hose 12 passes upwardly through the machine and has a reinforcing tubular fabric 14 knitted about the outer periphery. The knitting machine comprises a stationary, hollow needle cylinder means 60 and a cooperating upper needle stem means 18 of reduced diameter. A plurality of needles 20 of the known offset type to function with a needle cylinder 60 and needle stem 18 of different diameters are reciprocal between an upper position and a lower position as hereinafter more fully set forth. The needles 20 are reciprocal within needle guides 16 which are secured in the slots or grooves 22 defined by two side walls and a bottom provided in the needle cylinder 60 and within exterior slots or grooves 56 provided in the needle stem 18. The walls of the groove 22 are shown in FIG. 5 to be parallel to a radial line drawn from the rotational axis of the needle cylinder. The needle guides 16 are retained within the slots 22 of the needle cylinder 60 by upper and lower retaining rings 26, 27 in known manner. Machine screws 31 conventionally affix the retaining rings 27 to the needle cylinder 60 by acting through the holes 33 and threadedly engaging the threaded opening 35 provided in the needle cylinder. The knitting needles 20 are conventional in form and include the usual hook 28 and latch 30.

The needles 20 are mounted for reciprocation in the needle grooves 22 within the needle guides 16 and to this end are provided with butts 32 which radially project inwardly from the needle shank to engage in the cam track 34 which is formed in the cam rings 36, 38. The lower portion (not shown) of the cam ring 38 is provided with means (not shown) to rotate the cam track 34 and this rotation effects longitudinal reciprocation of the needles relative to the stationary needle cylinder 60 and needle stem 18. A rotary knitting head 40 is axially aligned with the needle stem 18 and needle cylinder 60 and is provided in the usual manner to cooperate with the reciprocating knitting needles 20 to form the knitted, tubular fabric 14. The knitting head 40 is rotated synchronously with the cam rings 36, 38 by conventional drive means (not shown) and includes hold down ring 42 which may be either stationary as shown in my U.S. Pat. No. 3,543,280 or which may be rotatable as shown in my pending application Ser. No. 333,969, now U.S. Pat. No. 3,879,961, which embraces the upper portion of the knitting needles 20 when the needles are in the stitch clearing position. The knitting head 40 terminates in spaced relation to the needle stem 18 to define an annular work slot 44 through which the knitted fabric 14 may be drawn as it is knitted.

Referring now to FIGS. 2 and 3, I show the needle stem 18 including a generally planar base flange 46 which is conventionally provided with a plurality of bolt holes 48 to receive therein the machine bolts 50 in a conventional manner to secure the needle stem 18 to the needle cylinder 60 in stationary relationship. The base flange 46 supports a hollow, generally cylindrical body 52 which includes a grooved portion 54 at least along a part of its vertical extension. The grooved portion 54 is provided with a plurality of grooves 56 which are spaced about the periphery thereof to receive therein the upper sections 58 of the offset knitting needles 20. As illustrated, it is usually desirable to provide an enlarged forecut 63 at the upward extension of each needle slot 56 to facilitate function of the needle latches. Each needle slot 56 is circumferentially angularly offset from the vertical to thereby guide the needle section 58 in an angularly offset direction as the knitting needles 20 are reciprocated by action of the cam track 34. The forecut portion 63 of each needle slot 56 is similarly angularly inclined. I have found an angular inclination of five degrees from the vertical to have been most satisfactory for the intended purpose. Experiments have shown that angular inclinations of between one degree from the vertical to ten degrees from the vertical to be satisfactory and to be superior to prior art models. The angular inclination allows the needle butts to function within the cam tract 34 in an improved manner without binding, undue friction or other undesirable rubbing.

Referring now to FIGS. 4 and 5, the needle cylinder 60 is shown in detail wherein the needle cylinder comprises generally a hollow cylindrical body 61. A plurality of slots 22 are formed in the needle cylinder body 60 and are peripherally spaced thereabout. The slots 22 may be interiorly formed or exteriorly formed in the needle cylinder 60.

Figure 7:
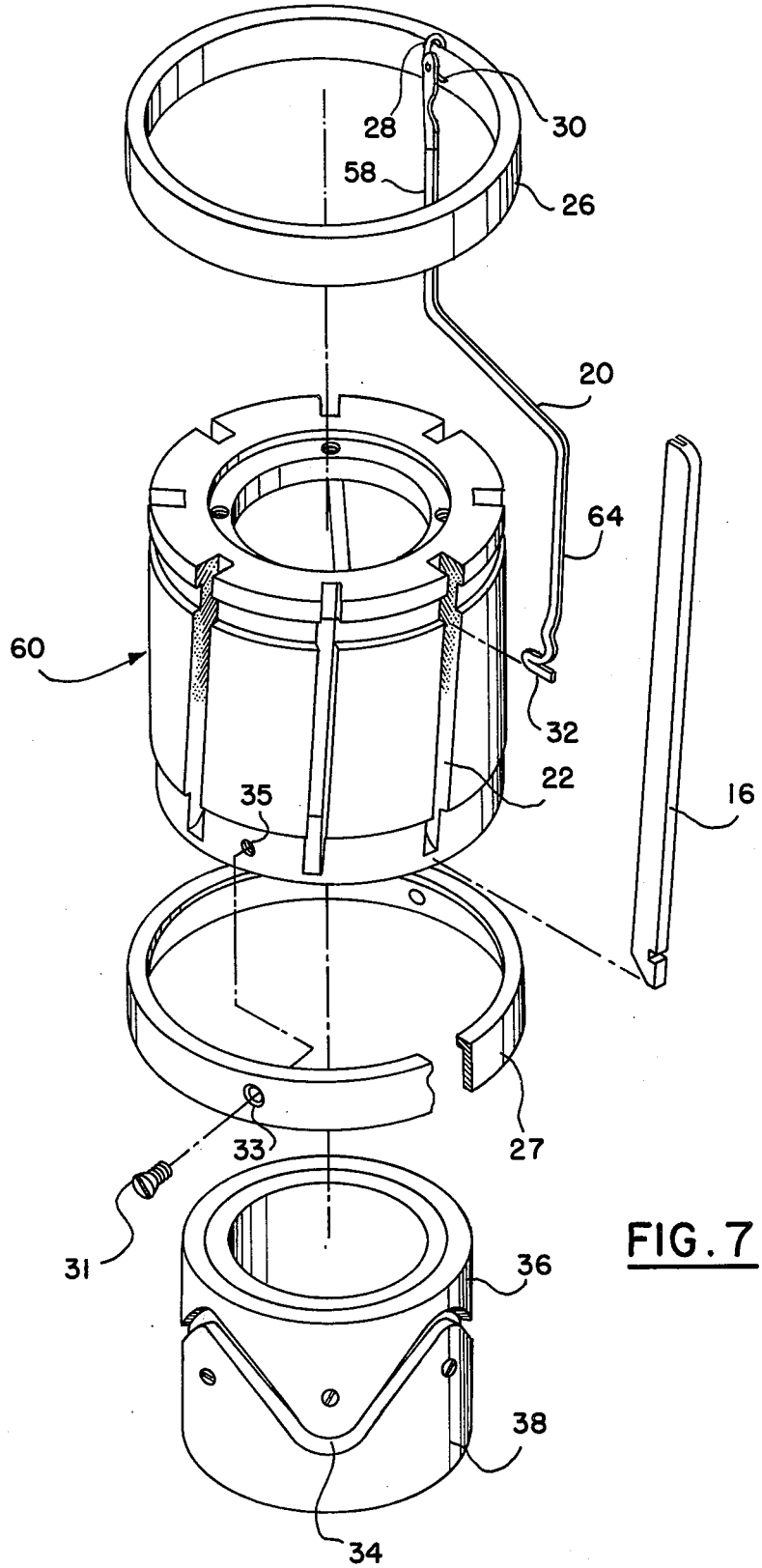
FIG. 7 is an enlarged, exploded, perspective view of the operating parts.

As best seen in FIGS. 4 and 7, all of the slots 22 are circumferentially angularly inclined from the vertical to receive the respective lower section 64 of the knitting needles 20 within the needle guide 16 in sliding arrangement. All of the slots 22 are angularly inclined to the same inclination from the vertical and to the same angular inclination as the exterior slots 56 which are formed in the needle stem 18. Each upper slot 56 which is machined in the needle stem 18 lies in a linear extension of the angularly inclined plane which is drawn through a lower slot 22 of the needle cylinder 60 to cooperatively accommodate a respective lower section 64 and upper section 58 of each knitting needle 20. As each needle 20 is reciprocated by action of the butts 32 acting within the cam track 34, each needle 20 will ride within a longitudinally aligned pair of angularly inclined slots comprising one lower slot 22 and one upper slot 56. Accordingly, each needle 20 when in use will be similarly angularly offset from the vertical to the same angular inclination as the upper and lower pairs of slots 22, 56, for example, five degrees from the vertical.

Referring now to FIG. 6, there is illustrated a schematic arrangement of adjacent knitting needles 20A, 20B relative to the cam track 34 showing the reciprocation of the knitting needles between their respective stitch forming and latch clearing positions as cam track 34 is rotated. It should be noted that the cam track shown diagrammatically at 34A is a schematic linear development of the cam track 34 of the cam rings 36, 38. The needles 20A, 20B are all angularly inclined at approximately five degrees from the vertical to thereby decrease the pressure angle the needles form with the cam track a hereinbefore set forth. As the cam track 34 is rotated, the needles are reciprocally urged along their respective inclined paths to conventionally knit a tubular fabric by drawing loops and casting off stitches in well known manner.

Although I have described the present invention with reference to the particular embodiments herein set forth, it is understood that the present disclosure has been made only by way of example and that numerous changes in the details of construction may be resorted to without departing from the spirit and scope of the invention. Thus, the scope of the invention should not be limited by the foregoing specification, but rather only by the scope of the claims appended hereto.

I claim:

1. In a circular knitting machine having a rotational axis, the combination of A. a needle cylinder means to guide a plurality of knitting needles,

1. said needle cylinder means being provided with a plurality of lower knitting needle receiving grooves, the grooves defining two side walls and a bottom,

2. said lower grooves being angularly inclined relative to the axis,

3. any two points on a groove bottom being equidistant from the axis;

4. the walls of the groove being generally parallel to a radial line drawn from said axis B. a plurality of knitting needles having first portions thereof positioned within the lower grooves,

1. said knitting needles being movable within the said lower grooves in an inclined orientation which is offset from the axis; and C. cam track means receiving a second portion of the knitting needles therein and being rotated relative to the needle cylinder means to move the knitting needles within the lower grooves.

2. The circular knitting machine of claim 1 wherein the needle cylinder means include a hollow cylindrical body having an exterior surface and an interior surface and wherein at least some of the lower grooves are formed in the exterior surface.

3. The circular knitting machine of claim 1 wherein at least some of the lower grooves incline in a non-radial direction.

4. The circular knitting machine of claim 3 wherein at least some of the lower grooves are circumferentially inclined.

5. The circular knitting machine of claim 1 and a needle stem means positioned above the needle cylinder means, said needle stem means having a plurality of upper knitting needle receiving grooves formed therein, a third portion of at least some of said knitting needles being movable within the said upper grooves.

6. The circular knitting machine of claim 5 wherein the needle stem means include a hollow cylindrical upper body having an exterior surface and an interior surface and wherein at least some of the upper grooves are formed in the exterior surface.

7. The circular knitting machine of claim 5 wherein at least some of the upper grooves are inclined relative to the axis.

8. The circular knitting machine of claim 5 wherein at least some of the upper grooves are circumferentially inclined.

9. The circular knitting machine of claim 8 wherein at least one upper groove lies in a plane which is a linear extension of a plane drawn throug a lower groove.

10. The circular knitting machine of claim 8 wherein the diameter of the needle stem means is less than the diameter of the needle cylinder means.

11. The circular knitting machine of claim 10 wherein at least some of the knitting needles include an offset portion between the first portion and the third portion and wherein at least some of said knitting needles are circumferentially inclined relative to the axis.

12. The circular knitting machine of claim 11 wherein at least some of the upper grooves lie in planes which are linear extensions of planes drawn through at least some of the lower grooves, the said planes being angularly inclined relative to the axis.

13. The circular knitting machine of claim 12 wherein at least some of the offset portions lie within extensions of the said planes.

14. The circular knitting machine of claim 5 wherein at least some of the upper knitting needle receiving grooves are defined by respective bottoms and wherein any two points on a bottom are equidistant from the axis.

* * * * *